US010036378B2

(12) United States Patent
Seith

(10) Patent No.: US 10,036,378 B2
(45) Date of Patent: Jul. 31, 2018

(54) POSITIVE DISPLACEMENT PUMP WITH PRESSURE COMPENSATING CALIBRATION

(71) Applicant: Ingersoll-Rand Company, Davidson, NC (US)

(72) Inventor: Warren Andrew Seith, Bethlehem, PA (US)

(73) Assignee: Ingersoll-Rand Company, Davidson, NC (US)

( * ) Notice: Subject to any disclaimer, the term of this patent is extended or adjusted under 35 U.S.C. 154(b) by 951 days.

(21) Appl. No.: 13/780,079

(22) Filed: Feb. 28, 2013

(65) Prior Publication Data

US 2014/0241905 A1 Aug. 28, 2014

(51) Int. Cl.

| | |
|---|---|
| ***F04B 43/073*** | (2006.01) |
| ***F04B 43/00*** | (2006.01) |
| ***F04B 43/067*** | (2006.01) |
| ***F04B 49/06*** | (2006.01) |
| ***F04B 49/12*** | (2006.01) |
| ***F04B 43/02*** | (2006.01) |

(52) U.S. Cl.

CPC ..... *F04B 43/0736* (2013.01); *F04B 43/0081* (2013.01); *F04B 43/026* (2013.01); *F04B 43/067* (2013.01); *F04B 43/073* (2013.01); *F04B 49/065* (2013.01); *F04B 49/12* (2013.01)

(58) Field of Classification Search

USPC ..... 222/23, 30, 36, 38, 52, 55, 56, 71

See application file for complete search history.

(56) References Cited

U.S. PATENT DOCUMENTS

| | | | | |
|---|---|---|---|---|
| 4,486,190 A * | 12/1984 | Reinicke | ..... | A61M 5/14276 604/67 |
| 5,257,914 A | 11/1993 | Reynolds | | |
| 5,786,012 A | 7/1998 | Peterson | | |
| 5,816,778 A | 10/1998 | Elsey, Jr. et al. | | |
| 6,126,403 A | 10/2000 | Yamada | | |

(Continued)

FOREIGN PATENT DOCUMENTS

| | | |
|---|---|---|
| DE | 4230662 A1 | 3/1993 |
| EP | 1906019 A2 | 4/2008 |
| WO | 2010088007 A1 | 8/2010 |

OTHER PUBLICATIONS

International Searching Authority, International Search Report and Written Opinion for PCT/US2014/013993, dated Jul. 7, 2014, 11 pages.

(Continued)

*Primary Examiner* — Kenneth J Hansen

(74) *Attorney, Agent, or Firm* — Barnes & Thornburg LLP

(57) ABSTRACT

Illustrative embodiments of positive displacement pumps utilizing pressure compensating calibration, as well as related systems and methods, are disclosed. In one illustrative embodiment, a method of operating a positive displacement pump includes sensing, with a pressure sensor disposed at a fluid outlet of the positive displacement pump, a back pressure at the fluid outlet, transmitting a pressure signal associated with the sensed back pressure from the pressure sensor to a controller of the positive displacement pump, and identifying, on the controller, a volume of fluid pumped by the positive displacement pump using the pressure signal.

2 Claims, 7 Drawing Sheets

(56) References Cited

U.S. PATENT DOCUMENTS

| | | | | |
|---|---|---|---|---|
| 6,241,487 | B1 | 6/2001 | Reynolds | |
| 6,329,013 | B1 | 12/2001 | Putt | |
| 6,402,486 | B1 | 6/2002 | Steck et al. | |
| 6,957,952 | B1 | 10/2005 | Steck et al. | |
| 7,458,309 | B2 | 12/2008 | Simmons et al. | |
| 7,517,199 | B2 | 4/2009 | Reed et al. | |
| 7,658,598 | B2 | 2/2010 | Reed et al. | |
| 2003/0009428 | A1 | 1/2003 | Barbe | |
| 2004/0084475 | A1* | 5/2004 | Bethuy et al. | 222/1 |
| 2005/0048206 | A1 | 3/2005 | Chinander et al. | |
| 2005/0123408 | A1* | 6/2005 | Koehl | 417/53 |
| 2007/0041845 | A1* | 2/2007 | Freudenberger | 417/63 |
| 2007/0267065 | A1 | 11/2007 | Okumura et al. | |
| 2010/0040483 | A1 | 2/2010 | Berger | |
| 2010/0196168 | A1* | 8/2010 | Kozumplik et al. | 417/1 |
| 2012/0051945 | A1* | 3/2012 | Orndorff et al. | 417/53 |
| 2012/0282111 | A1* | 11/2012 | Nip | F04B 49/06 417/48 |

OTHER PUBLICATIONS

Ingersoll Rand Company LTD, "Operator's Manual: 67072 Cycle Controller," 2010, pp. 1-4.

* cited by examiner

POSITIVE DISPLACEMENT PUMP WITH PRESSURE COMPENSATING CALIBRATION

TECHNICAL FIELD

The present disclosure relates, generally, to positive displacement pumps and, more particularly, to positive displacement pumps utilizing pressure compensating calibration.

BACKGROUND

Positive displacement pumps deliver a discrete volume of pumped fluid during each stroke or cycle of operation. As such, positive displacement pumps are often used for metering or dosing applications. Prior pump systems typically assume a fixed volume of pumped fluid will be delivered during each stroke or cycle of operation of the positive displacement pump. Such systems, however, fail to account for changes in the amount of pumped fluid that will actually be delivered during each stroke or cycle of operation due to variations in back pressure present at a fluid outlet of the positive displacement pump (and/or in the speed at which the positive displacement pump is operated), leading to volumetric inaccuracies.

SUMMARY

According to one aspect, a pump system may comprise a diaphragm pump including (i) a shaft coupled to a diaphragm and configured to move reciprocally between a first end-of-stroke position and a second end-of-stroke position, (ii) a stroke sensor configured to sense whether the shaft has reached one of the first and second end-of-stroke positions, (iii) a pressure sensor disposed at a fluid outlet of the diaphragm pump and configured to sense a back pressure at the fluid outlet, and (iv) a solenoid valve configured to control supply of a motive fluid that causes the shaft to move between the first and second end-of-stroke positions. The pump system may further comprise a controller communicatively coupled to the diaphragm pump and configured to (i) identify whether the shaft has reached one of the first and second end-of-stroke positions using a stroke signal received from the stroke sensor, (ii) identify a total volume of fluid pumped by the diaphragm pump using a pressure signal generated by the pressure sensor, and (iii) transmit a control signal to the solenoid valve in response to identifying that the shaft is in one of the first and second end-of-stroke positions and that the total volume of fluid pumped by the diaphragm pump has not yet reached a target volume, the control signal actuating the solenoid valve such that the motive fluid causes the shaft to move between the first and second end-of-stroke positions.

In some embodiments, the controller may be configured to identify the total volume of fluid pumped by the diaphragm pump, at least in part, by referencing a lookup table to determine a volume that corresponds to a sensed back pressure. The lookup table may include a plurality of entries that each associate a back pressure with a measured volume of fluid that was pumped at that back pressure during a calibration of the diaphragm pump. The controller may be configured to identify the total volume of fluid pumped by the diaphragm pump in response to identifying that the shaft has reached one of the first and second end-of-stroke positions.

In some embodiments, the controller may be configured to identify the total volume of fluid pumped by the diaphragm pump, at least in part, by determining a volume of fluid pumped by the diaphragm pump during a stroke of the diaphragm pump using one or more values of the pressure signal during the stroke and adding the volume of fluid pumped during the stroke of the diaphragm pump to the total volume of fluid pumped by the diaphragm pump. The controller may be configured to identify the total volume of fluid pumped by the diaphragm pump, at least in part, by determining a volume of fluid pumped by the diaphragm pump during each of a plurality of strokes of the diaphragm pump using one or more values of the pressure signal during each of the plurality of strokes and summing the volumes of fluid pumped by the diaphragm pump during the plurality of strokes.

According to another aspect, a method of operating a diaphragm pump may comprise sensing whether a shaft coupled to a diaphragm has reached an end-of-stroke position using a stroke sensor of the diaphragm pump, identifying, on a controller of the diaphragm pump, whether the shaft is in the end-of-stroke position using a stroke signal generated by the stroke sensor, sensing a back pressure at a fluid outlet of the diaphragm pump using a pressure sensor disposed at the fluid outlet, identifying, on the controller, a total volume of fluid pumped by the diaphragm pump using a pressure signal generated by the pressure sensor, and actuating a solenoid valve, in response to identifying that the shaft is in the end-of-stroke position and that the total volume of fluid pumped by the diaphragm pump has not yet reached a target volume, to cause a motive fluid to be supplied to the diaphragm such that the shaft moves from the end-of-stroke position.

In some embodiments, identifying the total volume of fluid pumped by the diaphragm pump using the pressure signal may include referencing a lookup table to determine a volume that corresponds to a sensed back pressure. The method may further include performing a calibration of the diaphragm pump. The calibration may include stroking the diaphragm pump at a plurality of back pressures, measuring, for each of the plurality of back pressures, a volume of fluid pumped during a stroke of the diaphragm pump, and creating a plurality of entries in the lookup table, each of the plurality of entries associating one of the plurality of back pressures with the measured volume of fluid pumped at that back pressure.

In some embodiments, identifying the total volume of fluid pumped by the diaphragm pump may include determining a volume of fluid pumped by the diaphragm pump during a stroke of the diaphragm pump using one or more values of the pressure signal during the stroke, and adding the volume of fluid pumped during the stroke of the diaphragm pump to the total volume of fluid pumped by the diaphragm pump. Identifying the total volume of fluid pumped by the diaphragm pump may include determining a volume of fluid pumped by the diaphragm pump during each of a plurality of strokes of the diaphragm pump using one or more values of the pressure signal during each of the plurality of strokes, and summing the volumes of fluid pumped by the diaphragm pump during the plurality of strokes.

According to yet another aspect, a method of operating a positive displacement pump may comprise sensing, with a pressure sensor disposed at a fluid outlet of the positive displacement pump, a back pressure at the fluid outlet, transmitting a pressure signal associated with the sensed back pressure from the pressure sensor to a controller of the positive displacement pump, and identifying, on the controller, a volume of fluid pumped by the positive displacement pump using the pressure signal.

In some embodiments, identifying the volume of fluid pumped by the positive displacement pump using the pressure signal may include referencing a lookup table to determine a volume that corresponds to a sensed back pressure. The method may further include performing a calibration of the positive displacement pump. The calibration may include cycling the positive displacement pump at a plurality of back pressures, measuring, for each of the plurality of back pressures, a volume of fluid pumped during a cycle of the positive displacement pump, and creating a plurality of entries in the lookup table, each of the plurality of entries associating one of the plurality of back pressures with the measured volume of fluid pumped at that back pressure.

In some embodiments, identifying the volume of fluid pumped by the positive displacement pump may include determining a volume of fluid pumped during a past cycle of the positive displacement pump using one or more values of the pressure signal during the past cycle. The method may further include adding the volume of fluid pumped during the past cycle of the positive displacement pump to a total volume of fluid pumped by the positive displacement pump and cycling the positive displacement pump in response to determining that the total volume of fluid pumped by the positive displacement pump has not yet reached a target volume.

In some embodiments, identifying the volume of fluid pumped by the positive displacement pump may include determining a total volume of fluid pumped during a plurality of cycles of the positive displacement pump using one or more values of the pressure signal during each of the plurality of cycles. The method may further include cycling the positive displacement pump in response to determining that the total volume of fluid pumped during the plurality of cycles of the positive displacement pump has not yet reached a target volume.

In some embodiments, identifying the volume of fluid pumped by the positive displacement pump may include predicting a volume of fluid that will be pumped during a next cycle of the positive displacement pump using a present value of the pressure signal. The method may further include cycling the positive displacement pump in response to determining that the predicted volume of fluid that will be pumped during the next cycle of the positive displacement pump will bring a total volume of fluid pumped by the positive displacement pump closer to a target volume.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION OF THE DRAWINGS

Figure 1:
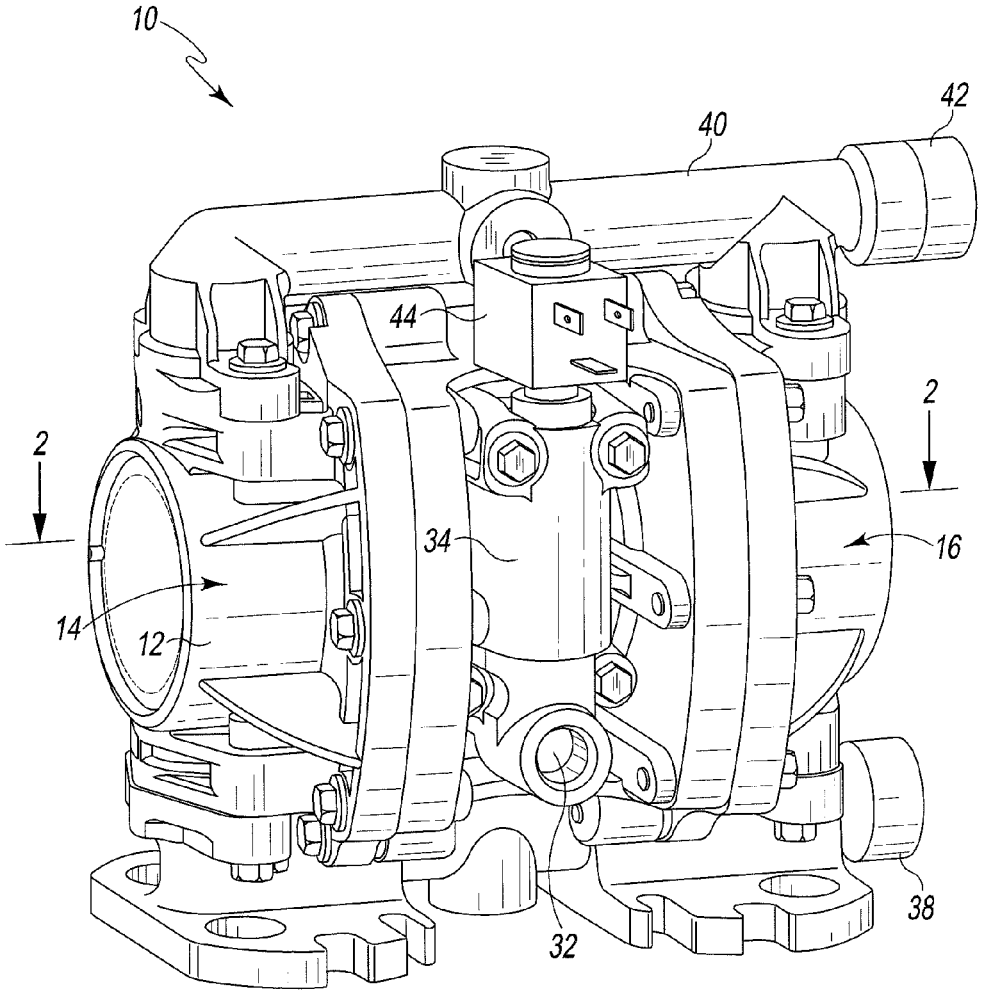
FIG. 1 is a front perspective view of at least one embodiment of a double diaphragm pump.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Figure 2:
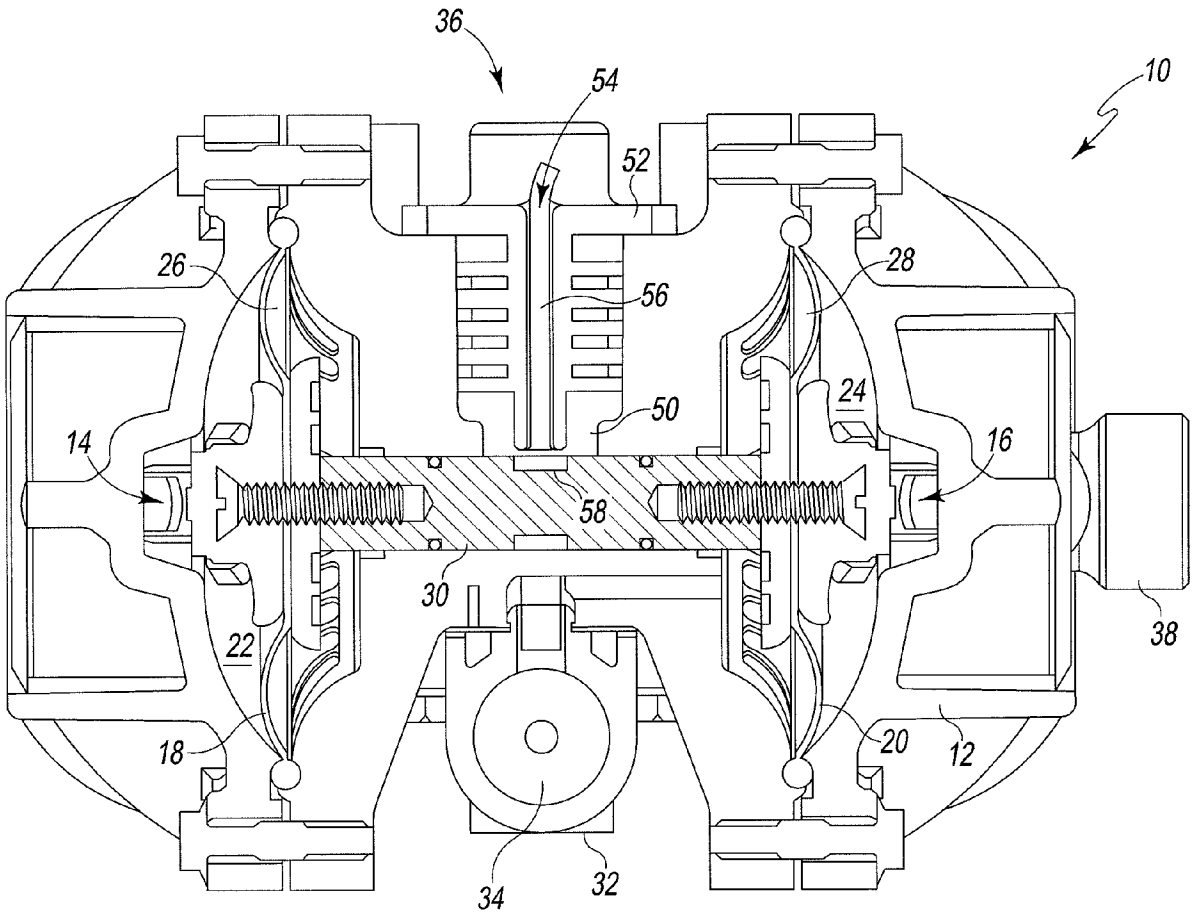
FIG. 2 is a cross-sectional view of the pump of FIG. 1, taken along the line 2-2 in FIG. 1.

Referring now to FIGS. 1 and 2, one illustrative embodiment of a positive displacement pump 10 is shown. The pump 10 of FIGS. 1 and 2 is illustratively embodied as a double-diaphragm pump. It is contemplated that, in other embodiments, the pump 10 may be embodied as any other type of positive displacement pump (including, but not limited to, any other type of diaphragm pump). In the illustrative embodiment, the pump 10 has a housing 12 that defines a first working chamber 14 and a second working chamber 16. In the illustrative embodiment, the housing 12 is comprised of three sections coupled together by fasteners. As best seen in FIG. 2, the first and second working chambers 14, 16 of the pump 10 are each divided with respective first and second flexible diaphragms 18, 20 into respective first and second pump chambers 22, 24 and first and second motive fluid chambers 26, 28. The diaphragms 18, 20 are interconnected by a shaft 30, such that when the diaphragm 18 is moved to increase the volume of the associated pump chamber 22, the other diaphragm 20 is simultaneously moved to decrease the volume of the associated pump chamber 24, and vice versa.

The shaft 30 illustrated in FIG. 2 is a reciprocating diaphragm link rod having a fixed length, such that the position of the shaft 30 in the pump 10 is indicative of the position of the diaphragms 18, 20. The shaft 30 and diaphragms 18, 20 move back and forth a fixed distance that defines a stroke. The fixed distance is determined by the geometry of the pump 10, the shaft 30, the diaphragms 18, 20, and other components of the pump 10 (e.g., the diaphragm washers). A stroke is defined as the travel path of the shaft 30 between first and second end-of-stroke positions. Movement of the shaft 30 from one end-of-stroke position to the other end-of-stroke position and back defines a cycle of operation of the shaft 30 (i.e., a cycle includes two consecutive strokes).

The pump 10 includes an inlet 32 for the supply of a motive fluid (e.g., compressed air, or another pressurized gas) and a major valve 34 for alternately supplying the motive fluid to the first and second motive fluid chambers 26, 28 to drive reciprocation of the diaphragms 18, 20 and the shaft 30. When the major valve 34 supplies motive fluid to the motive fluid chamber 26, the major valve 34 places an exhaust assembly 36 in communication with the other motive fluid chamber 28 to permit motive fluid to be expelled therefrom. Conversely, when the major valve 34 supplies motive fluid to the motive fluid chamber 28, the major valve 34 places the motive fluid chamber 26 in communication with the exhaust assembly 36. In the illustrative embodiment of the pump 10, movement of the major valve 34 between these positions is controlled by a solenoid valve 44. As such, by controlling movement of the major valve 34, the solenoid valve 44 of the pump 10 controls the supply of the motive fluid to the first and second motive fluid chambers 26, 28.

The exhaust assembly 36 of the pump 10 includes an exhaust chamber 50 and a muffler 52 that is received in the exhaust chamber 50. The exhaust assembly 36 may have a design similar to the exhaust system described in U.S. patent application Ser. No. 13/741,057 to Treml et al., the entire disclosure of which is incorporated by reference herein. In the illustrative embodiment shown in FIG. 2, the muffler 52 includes a sensor mounting chamber 54 formed therein, and a stroke sensor 56 is disposed within the sensor mounting chamber 54. The stroke sensor 56 is illustratively embodied as a proximity sensor that detects the presence or absence of material (or a particular type of material) within a certain distance of the sensor. The shaft 30 may include one or more features that are detectable by the stroke sensor 56 when the shaft 30 reciprocates between the first and second end-of-stroke positions. In the illustrative embodiment shown in FIG. 2, the shaft 30 includes a central notch 58 where the shaft 30 has a smaller diameter. In this embodiment, the stroke sensor 56 will not be triggered when the shaft 30 is in a centered position within the pump 10 (i.e., the position shown in FIG. 2), as no material is present within the sensing field of the stroke sensor 56. As the shaft 30 moves toward one of the end-of-stroke positions, the material of a larger diameter portion of the shaft 30 will enter the sensing field of the stroke sensor 56 and trigger the stroke sensor 56. Other possible configurations for the shaft 30 that may be sensed by the stroke sensor 56 are described in U.S. Patent Application Publication No. 2010/0196168 to Kozumplik et al., the entire disclosure of which is incorporated by reference herein.

It is contemplated that, in other embodiments of the pump 10, the stroke sensor 56 may be any type of sensor capable of sensing whether the shaft 30 has reached one of the first and second end-of-stroke positions and may be positioned in any number of locations within the pump 10. For instance, in some embodiments, the stroke sensor 56 may be a pressure switch fluidly coupled to a pilot valve (not shown) of the pump 10. In such embodiments, the stroke sensor 56 may measure a pressure at the pilot valve of the pump 10 to determine whether the shaft 30 has reached one of the first and second end-of-stroke positions. In still other embodiments of the pump 10, the stroke sensor 56 may be embodied as an optical sensor capable of sensing whether the shaft 30 has reached one of the first and second end-of-stroke positions. It will be appreciated that the foregoing examples (i.e., a proximity sensor, a pressure sensor, and an optical sensor) are merely illustrative and should not be seen as limiting the stroke sensor 56 to any particular type of sensor.

During operation of the pump 10, as the shaft 30 and the diaphragms 18, 20 reciprocate, the first and second pump chambers 22, 24 alternately expand and contract to create respective low and high pressure within the respective first and second pump chambers 22, 24. The pump chambers 22, 24 each communicate with an inlet manifold 38 that may be connected to a source of fluid to be pumped and also each communicate with an outlet manifold, or fluid outlet, 40 that may be connected to a receptacle for the fluid being pumped. Check valves (not shown) ensure that the fluid being pumped moves only from the inlet manifold 38 toward the outlet manifold 40. For instance, when the pump chamber 22 expands, the resulting negative pressure draws fluid from the inlet manifold 38 into the pump chamber 22. Simultaneously, the other pump chamber 24 contracts, which creates positive pressure to force fluid contained therein into the outlet manifold 40. Subsequently, as the shaft 30 and the diaphragms 18, 20 move in the opposite direction, the pump chamber 22 will contract and the pump chamber 24 will expand (forcing fluid contained in the pump chamber 24 into the outlet manifold 40 and drawing fluid from the inlet manifold 38 into the pump chamber 24). The pump 10 also includes a pressure sensor 42 connected to, or forming a part of, the outlet manifold 40. The pressure sensor 42 may be embodied as any type of sensor capable of determining a pressure of a fluid being pumped through the fluid outlet 40.

Figure 3:
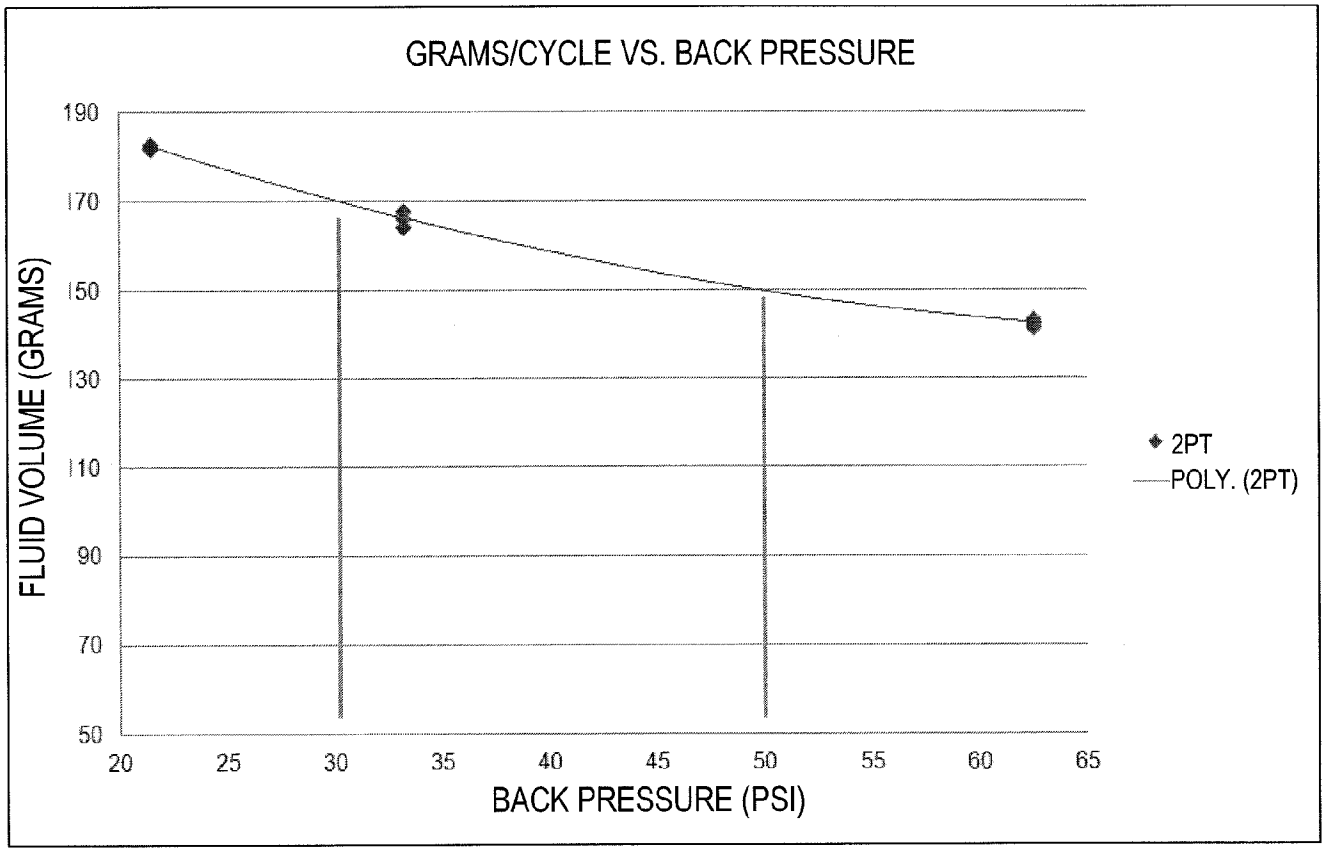
FIG. 3 is graph illustrating an exemplary relationship between back pressure and volume of pumped fluid delivered by the pump of FIGS. 1 and 2.

The combined size of the first and second pump chambers 22, 24 generally defines the discrete volume of pumped fluid that will be delivered through the fluid outlet 40 during each cycle of the pump 10. As illustrated in the graph of FIG. 3, however, the actual volume of pumped fluid delivered by the pump 10 during each cycle also depends on the back pressure present at the fluid outlet 40. For instance, at a back pressure of about 30 pounds-per-square-inch ("psi"), one illustrative embodiment of the pump 10 delivered approximately 170 grams of pumped fluid per cycle. At a back pressure of about 50 psi, the same illustrative embodiment of the pump 10 delivered approximately 150 grams of pumped fluid per cycle. It will be appreciated by those of skill in the art that, for a particular pump 10, a general relationship between back pressure and volume of pumped fluid delivered by the pump 10 can be gleaned from such data.

Figure 4:
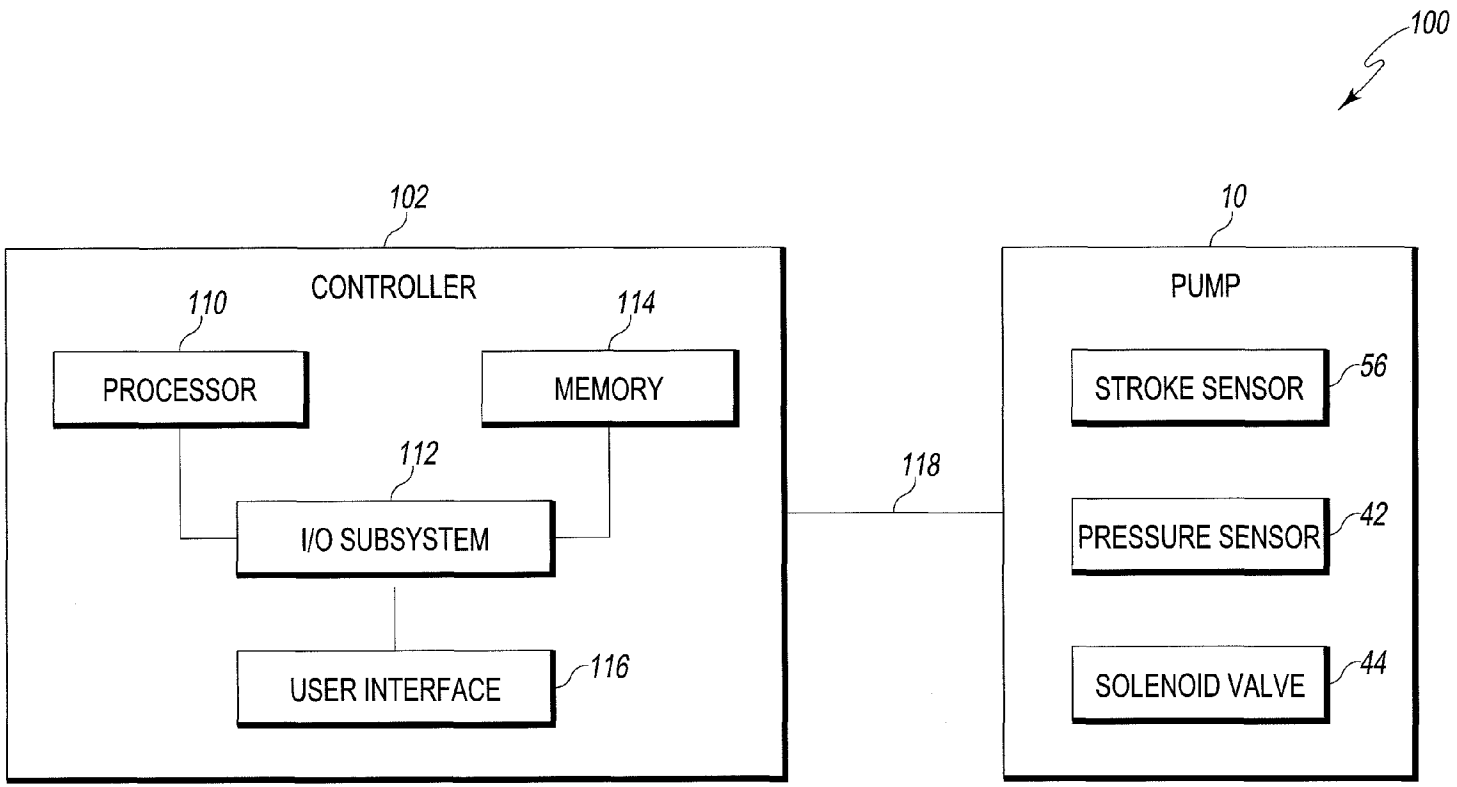
FIG. 4 is a simplified block diagram of at least one embodiment of a pump system including the pump of FIGS. 1 and 2.

Referring now to FIG. 4, one illustrative embodiment of a pump system 100 including the pump 10 of FIGS. 1 and 2 and a controller 102 is shown as a simplified block diagram. As described above, the pump 10 may include a solenoid valve 44, a pressure sensor 42, and a stroke sensor 56. In the illustrative embodiment shown in FIG. 3, the controller 102 is communicatively coupled to the solenoid valve 44, the pressure sensor 42, and the stroke sensor 56 of the pump 10 via one or more wired connections 118. In other embodiments, the controller 102 may be communicatively coupled to the solenoid valve 44, the pressure sensor 42, and the stroke sensor 56 via other types of connections (e.g., wireless or radio links). It should be appreciated that, in some embodiments, the controller 102 may constitute a part of the pump 10. The controller 102 is, in essence, the master computer responsible for interpreting signals sent by sensors associated with the pump 10 and for activating or energizing electronically-controlled components associated with the pump 10. For example, the controller 102 is configured to monitor various signals from the pressure sensor 42 and the stroke sensor 56, to control operation of the solenoid valve 44, and to determine when various operations of the pump system 100 should be performed, amongst many other things. In particular, as will be described in more detail below with reference to FIGS. 6 and 7, the controller 102 is operable to control the pump 10 to deliver a target volume of pumped fluid.

To do so, the controller 102 includes a number of electronic components commonly associated with electronic control units utilized in the control of electromechanical systems. In the illustrative embodiment, the controller 102 of the pump system 100 includes a processor 110, an input/output ("I/O") subsystem 112, a memory 114, and a user interface 116. It will be appreciated that the controller 102 may include other or additional components, such as those commonly found in a computing device (e.g., various input/output devices). Additionally, in some embodiments, one or more of the illustrative components of the controller 102 may be incorporated in, or otherwise form a portion of, another component of the controller 102 (e.g., as with a microcontroller).

The processor 110 of the controller 102 may be embodied as any type of processor capable of performing the functions described herein. For example, the processor may be embodied as one or more single or multi-core processors, digital signal processors, microcontrollers, or other processors or processing/controlling circuits. Similarly, the memory 114 may be embodied as any type of volatile or non-volatile memory or data storage device capable of performing the functions described herein. The memory 114 stores various data and software used during operation of the controller 102, such as operating systems, applications, programs, libraries, and drivers. For instance, the memory 114 may store instructions in the form of a software routine (or routines) which, when executed by the processor 110, allows the controller 102 to control operation of the pump 10. As described further below, the memory 114 may also store a lookup table including a number of entries that each associate a back pressure with a measured volume of fluid that was pumped at that back pressure during a calibration of the pump 10. The user interface 116 permits a user to interact with the controller 102 to, for example, initiate an automatic priming function of the pump system 100. As such, in some embodiments, the user interface 116 includes a keypad, touch screen, display, and/or other mechanisms to permit I/O functionality.

The memory 114 and the user interface 116 are communicatively coupled to the processor 110 via the I/O subsystem 112, which may be embodied as circuitry and/or components to facilitate I/O operations of the controller 102. For example, the I/O subsystem 112 may be embodied as, or otherwise include, memory controller hubs, I/O control hubs, firmware devices, communication links (e.g., point-to-point links, bus links, wires, cables, light guides, printed circuit board traces, etc.), and/or other components and subsystems to facilitate the I/O operations. In the illustrative embodiment, the I/O subsystem 112 includes an analog-to-digital ("A/D") converter, or the like, that converts analog signals from the pressure sensor 42 and the stroke sensor 56 of the pump 10 into digital signals for use by the processor 110. It should be appreciated that, if any one or more of the sensors associated with the pump 10 generate a digital output signal, the A/D converter may be bypassed. Similarly, in the illustrative embodiment, the I/O subsystem 112 includes a digital-to-analog ("D/A") converter, or the like, that converts digital signals from the processor 110 into analog signals for use by the solenoid valve 44 of the pump 10. It should also be appreciated that, if the solenoid valve 44 operates using a digital input signal, the D/A converter may be bypassed.

Figure 5:
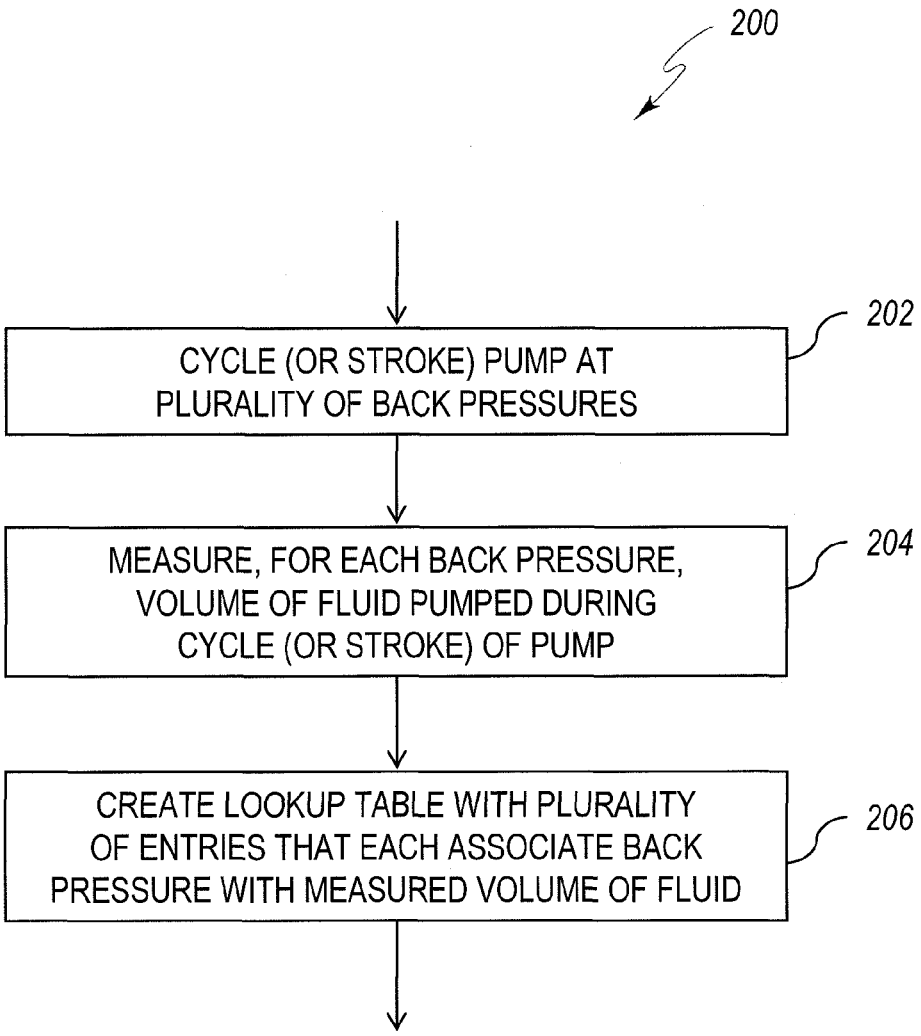
FIG. 5 is a simplified flow diagram of at least one embodiment of a method of calibrating the pump of FIGS. 1 and 2.

Referring now to FIG. 5, one illustrative embodiment of a method 200 of calibrating the pump 10 of FIGS. 1 and 2 is shown as a simplified flow diagram. The method 200 may be performed with a pump system 100 to generate a lookup table relating various back pressures to corresponding volumes of pumped fluid and, thus, to calibrate the pump 10 before performance of the methods 300, 400 (described below with reference to FIGS. 6 and 7, respectively), or similar methods of operating the pump 10, which utilize pressure compensating calibration. The method 200 may also be performed periodically with the pump system 100 to recalibrate the pump 10 (e.g., between metering or dosing applications). The method 200 is illustrated in FIG. 5 as a number of blocks 202-206, which may be performed by various components of the pump system 100 of FIG. 4.

The method 200 begins with block 202 in which the pump 10 is cycled or stroked at a plurality of back pressures. For instance, in some embodiments, block 202 may involve causing the pump 10 to execute a cycle of operation while a first back pressure is maintained at the fluid outlet 40 of the pump 10, then causing the pump 10 to execute another cycle of operation while a second back pressure is maintained at the fluid outlet 40 of the pump 10, then causing the pump 10 to execute another cycle of operation while a third back pressure is maintained at the fluid outlet 40 of the pump 10, and so on. In other embodiments, block 202 may involve causing the pump 10 to execute a single stroke (rather than a complete cycle) at each of the plurality of back pressures. In either case, block 202 will involve operating the pump 10 with at least two different back pressures present at the fluid outlet 40, but may involve operating the pump 10 at any number of back pressures. In the illustrative embodiment of the method 200, the pump 10 may be cycled or stroked over the entire range of back pressures that it may encounter in the field.

Block 204, in which a volume of fluid actually pumped during each cycle or stroke is measured, is performed simultaneously (or iteratively) with block 202 during the method 200. In other words, each time the pump 10 is cycled or stroked while a particular back pressure is maintained at the fluid outlet 40 in block 202, the actual volume of fluid delivered by the pump 10 is measured. By way of illustrative example, the controller 102 may measure the amount of fluid actually delivered by the pump 10 using a flow sensor (not shown) or other appropriate sensor. It is also contemplated that, in some embodiments, block 204 may be performed by a user of the pump system 100 and the resulting measurements may be manually entered into controller 102. Block 204 results in a measurement of the volume of fluid actually delivered by the pump 10 for each of the plurality of back pressures utilized in block 202.

After blocks 202 and 204, the method 200 continues to block 206 in which the controller generates a lookup table relating various back pressures to corresponding volumes of pumped fluid. In particular, the lookup table will contain a plurality of entries that each associate one of the plurality of back pressures utilized in block 202 with the corresponding volume of fluid measured in block 204. In other words, the lookup table may contain information similar to that illustrated in the graph of FIG. 3 (but in tabular form). As noted above, this lookup table may be stored in the memory 114 of the controller 102. As described further below, the lookup table may then be utilized by the controller 102 during performance of the methods 300, 400, or similar methods of operating the pump 10. It is contemplated that, in other embodiments of the method 200, block 206 may involve the controller 102 creating a mathematical function that relates back pressure to volume delivered by the pump 10 (rather than creating a lookup table).

Figure 6:
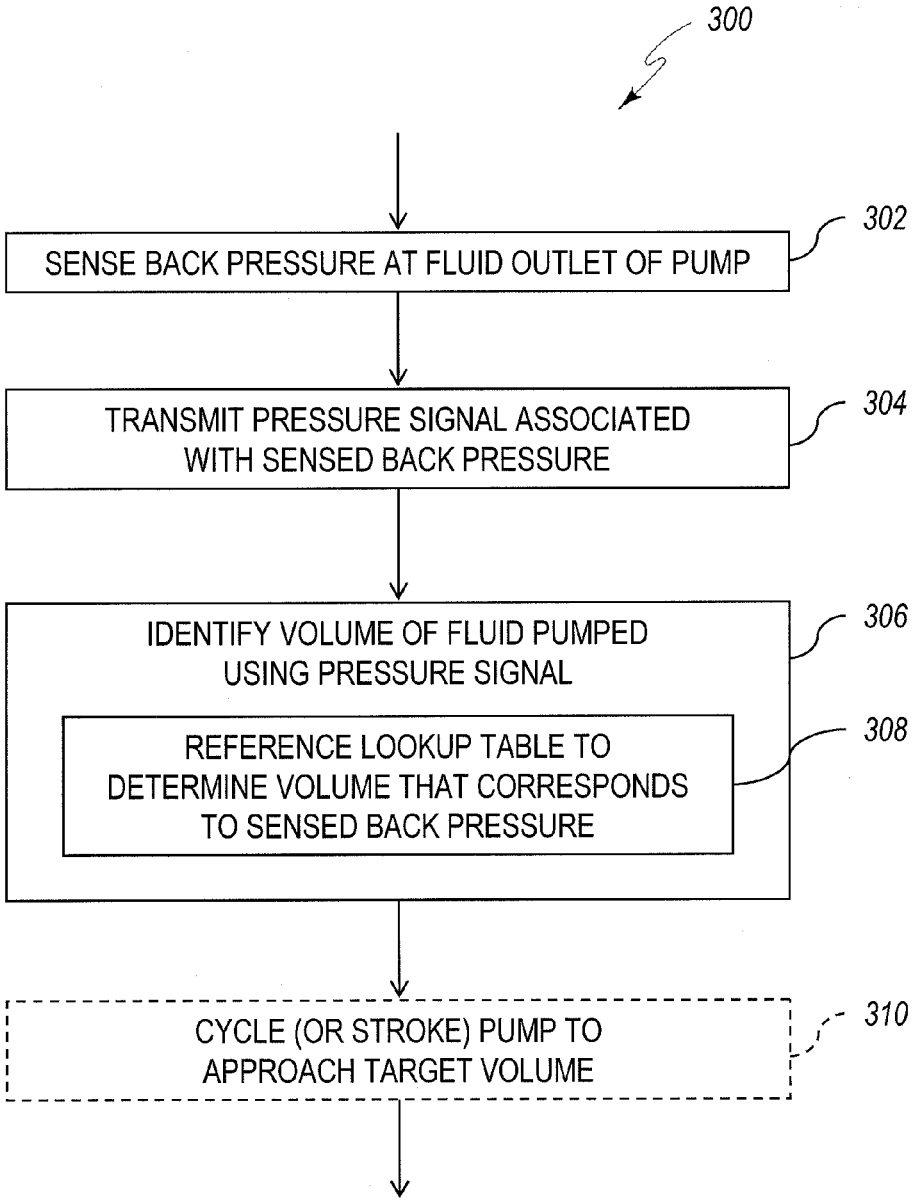
FIG. 6 is a simplified flow diagram of at least one embodiment of a method of operating the pump of FIGS. 1 and 2.

Referring now to FIG. 6, one illustrative embodiment of a method 300 of operating the pump 10 of FIGS. 1 and 2 is shown as a simplified flow diagram. The method 300 may be performed with a pump system 100 to accurately deliver a target volume of pumped fluid for a metering or dosing application. As noted above, the calibration method 200 of FIG. 5 (or a similar calibration of the pump 10) will generally be performed prior to utilizing the method 300. The method 300 may be initiated by a user of the pump system 100 (for instance, by selecting an appropriate input on the user interface 116 of the controller 102) or may be initiated by the controller 102 without user input. The method 300 is illustrated in FIG. 6 as a number of blocks 302-310, which may be performed by various components of the pump system 100 of FIG. 4.

The method 300 begins with block 302 in which the back pressure at the fluid outlet 40 of the pump 10 is determined using the pressure sensor 42. In other words, the pressure sensor 42 of the pump 10 senses the back pressure seen by the pump 10 and generates a pressure signal associated with the sensed pressure. In block 304, the pressure sensor 42 transmits this pressure signal to the controller 102, either continuously or intermittently, including, by way of example, in response to a query from the controller 102. It is contemplated that the blocks 302 and 304 may be performed continuously or intermittently during performance of the method 300 (including during the other blocks 306-310).

After block 304, the method 300 proceeds to block 306 in which the controller 102 identifies a volume of fluid delivered by the pump 10 using the pressure signal received in block 304. For example, in some embodiments, block 306 may involve determining the volume of fluid pumped during the most recent cycle or stroke of the pump 10. In such embodiments, the controller 102 may utilize one or more values of the pressure signal from this most recent cycle or stroke of the pump 10 to determine the back pressure seen by the pump 10. For instance, the controller 102 may utilize only the sensed back pressure at one point in the cycle or stroke. Alternatively, the controller 102 may average the sensed back pressures over the some part of the cycle or stroke. In the illustrative embodiment, block 306 involves block 308 in which the controller 102 references the lookup table stored in the memory 114 (generated during the calibration method 200) to determine a volume that corresponds to the sensed back pressure derived from the pressure signal. In other embodiments, block 306 may involve the controller 102 identifying the volume of fluid pumped in another manner (e.g., inputting one or more values of the pressure signal into a mathematical function that outputs the volume of pumped fluid). In embodiments where the volume of fluid delivered by the pump 10 during the last cycle or stroke is identified, block 306 may also involve the controller adding this volume to a total volume of fluid delivered by the pump 10 during the present metering or dosing event.

In other embodiments of the method 300, block 306 may involve identifying the total volume of fluid pumped during a plurality of cycles or strokes of the pump 10. In such embodiments, the controller 102 may utilize one or more values of the pressure signal from each of the plurality of cycles or strokes in this determination. In other words, in some embodiments, the controller 102 may determine the total volume of fluid delivered by the pump 10, using a sensed back pressure from each cycle or stroke (rather than making an individual calculation after each cycle or stroke). In still other embodiments of the method 300, block 306 may involve predicting a volume of fluid that will be pumped during the next cycle or stroke of the pump 10 using a present value of the pressure signal. In any of these embodiments, block 306 may involve block 308 in which the controller 102 determines the desired volume by referring to an entry for a particular sensed back pressure in a lookup table (or may involve any other suitable means of determining the volume from a sensed back pressure).

After block 306, the method 300 may optionally proceed to block 310 in which the controller 102 cycles or strokes the pump 10. Block 310 may involve the controller 102 comparing the total volume of pumped fluid delivered by the pump 10 (which may have been identified in block 306) with a target volume for the metering or dosing event. In particular, if the controller 102 determines, in block 310, that the total volume of pumped fluid has not yet reached the target volume, the controller 102 may cause the pump 10 to cycle or stroke (and may cause the method 300 to return to step 302). By contrast, if the controller 102 determines, in block 310, that the total volume of pumped fluid has reached the target volume, the method 300 may conclude. In embodiments in which the predicted volume of fluid to be delivered during the next cycle or stroke of the pump 10 is identified in block 306, block 310 may involve the controller determining whether pumping this predicted volume will bring the total volume of fluid pumped by the pump 10 closer to the target volume (or whether doing so would result in a new total volume that is farther away from the target volume).

Figure 7:
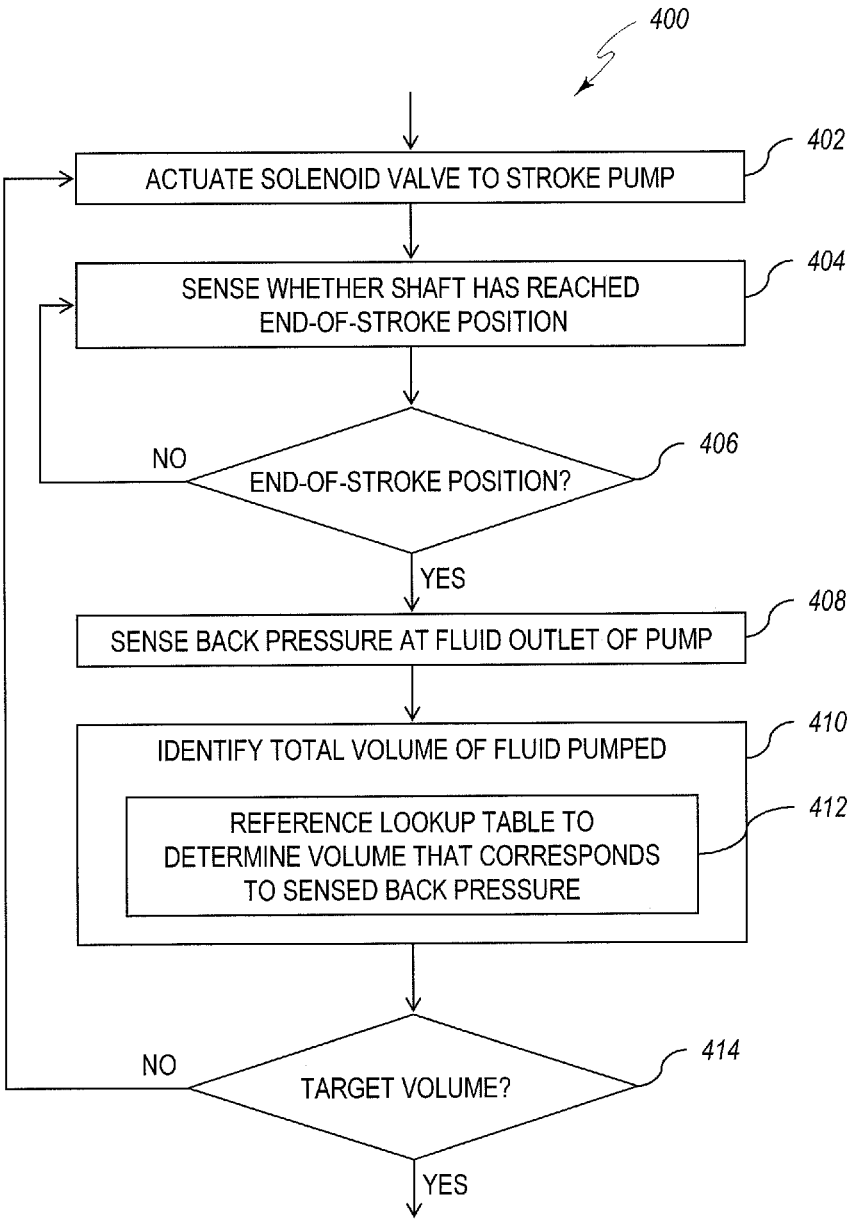
FIG. 7 is a simplified flow diagram of at least one other embodiment of a method of operating the pump of FIGS. 1 and 2.

Another illustrative embodiment of a method 400 of operating the pump 10 of FIGS. 1 and 2 is shown as a simplified flow diagram in FIG. 7. The method 400 may also be performed with a pump system 100 to accurately deliver a target volume of pumped fluid for a metering or dosing application. As noted above, the calibration method 200 of FIG. 5 (or a similar calibration of the pump 10) will generally be performed prior to utilizing the method 400. The method 400 may be initiated by a user of the pump system 100 (for instance, by selecting an appropriate input on the user interface 116 of the controller 102) or may be initiated by the controller 102 without user input. The method 400 is illustrated in FIG. 7 as a number of blocks 402-414, which may be performed by various components of the pump system 100 of FIG. 4.

The method 400 begins with block 402 in which the controller 102 transmits a control signal to actuate the solenoid valve 44. As discussed above, actuation of the solenoid valve 44 causes movement of the major valve 34, which supplies motive fluid to one of the motive fluid chambers 26, 28 of the pump 10, thereby stroking the pump 10 (i.e., moving the shaft 30 and diaphragms 18, 20 from one end-of-stroke position to the other end-of-stroke position) and causing fluid to be pumped through the fluid outlet 40.

After block 402, the method 400 proceeds to block 404 in which the controller 102 determines whether the shaft 30 has reached one of the end-of-stroke positions. In other words, the controller 102 identifies whether the shaft 30 has moved from one end-of-stroke position to the other end-of-stroke position. In the illustrative embodiment, block 404 involves the stroke sensor 56 (e.g., a proximity sensor) sensing a position of the shaft 30 and generating a stroke signal associated with the sensed position. In other embodiments, as discussed above, block 404 may involve another type of stroke sensor 56 (e.g., a pressure sensor, an optical sensor, etc.) generating a stroke signal that indicates whether the shaft 30 has reached one of the end-of-stroke positions. The stroke sensor 56 may transmit this stroke signal to the controller 102 continuously or intermittently, including, by way of example, in response to the shaft 30 reaching one of the end-of-stroke positions.

After block 404, the method 400 proceeds to block 406 in which the controller 102 determines whether to repeat block 404 or continue the method 400. If the controller 102 determined in block 404 that the shaft 30 had yet not reached one of the end-of-stroke positions, block 406 may involve the controller 102 returning the method 400 to block 404. As such, in the illustrative embodiment of FIG. 7, blocks 404, 406 will be repeated until the shaft 30 is in one of the end-of-stroke positions. If the controller 102 instead determined in block 404 that the shaft 30 had reached one of the end-of-stroke positions, the method 400 will proceed to block 408 in which the back pressure at the fluid outlet 40 of the pump 10 is determined using the pressure sensor 42. Block 408 may be similar to blocks 302, 304 described above with reference FIG. 6. It will be appreciated that, in some embodiments, block 408 may be performed continuously or intermittently during blocks 402-406 of the method 400.

After block 408, the method 400 proceeds to block 410 in which the controller 102 identifies a total volume of fluid delivered by the pump 10. In the illustrative embodiment, block 410 involves block 412 in which the controller 102 references the lookup table stored in the memory 114 (generated during the calibration method 200) to determine a volume that corresponds to the sensed back pressure. Block 410 and block 412 may be similar to block 306 and block 308, respectively, as described above with reference FIG. 6.

After block 410, the method 400 proceeds to block 414 in which the controller 102 determines whether the total volume of fluid pumped (which may be identified in block 410) has reached a target volume for the metering or dosing event. In particular, if the controller 102 determines, in block 414, that the total volume of pumped fluid has not yet reached the target volume, the controller 102 will cause the method 400 to return to step 402 (in the solenoid valve 44 will stroke the pump 10 to deliver more fluid). By contrast, if the controller 102 determines, in block 414, that the total volume of pumped fluid has reached the target volume, the method 400 will conclude.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A method of dispensing a target volume of a fluid from a diaphragm pump assembly the method comprising:

sensing whether a shaft coupled to a diaphragm of the diaphragm pump assembly has reached an end-of-stroke position using a stroke sensor to generate a stroke signal;

identifying, on a controller of the diaphragm pump assembly, whether the shaft is at the end-of-stroke position using the stroke signal generated by the stroke sensor;

sensing a back pressure at a fluid outlet of the diaphragm pump assembly using a pressure sensor disposed at the fluid outlet;

determining, on the controller, whether a total volume of fluid pumped has reached the target volume;

actuating a solenoid valve, in response to identifying that the shaft is in the end-of-stroke position and that the total volume of fluid pumped by the diaphragm pump assembly has not yet reached the target volume, to cause a motive fluid to be supplied to the diaphragm such that the shaft moves from the end-of-stroke position; and concluding movement of the shaft in response to the controller determining that the total volume of pumped fluid has reached the target volume.

2. A method of dispensing a target volume of a fluid from a diaphragm pump assembly the method comprising:

calibrating the diaphragm pump assembly prior to dispensing the target volume of fluid from the diaphragm pump assembly by the method comprising:

stroking the diaphragm pump assembly at a plurality of back pressures;

measuring, for each of the plurality of back pressures, a volume of the fluid pumped during the stroke of the diaphragm pump assembly; and building a plurality of entries in a lookup table, wherein each entry of the plurality of entries is composed of the measurement of the volume of the fluid pumped during a stroke associated with one of the plurality of back pressures;

operating the diaphragm pump assembly after building the lookup table to dispense the target volume of fluid according to the steps of:

sensing whether a shaft coupled to a diaphragm of the diaphragm pump assembly has reached an end-of-stroke position using a stroke sensor to generate a stroke signal;

identifying, on a controller of the diaphragm pump assembly, whether the shaft is at the end-of-stroke position using the stroke signal generated by the stroke sensor;

sensing a back pressure at a fluid outlet of the diaphragm pump assembly using a pressure sensor disposed at the fluid outlet;

determining, on the controller, whether a total volume of fluid pumped has reached the target volume;

actuating a solenoid valve, in response to identifying that the shaft is in the end-of-stroke position and that the total volume of fluid pumped by the diaphragm pump assembly has not yet reached the target volume, to cause a motive fluid to be supplied to the diaphragm such that the shaft moves from the end-of-stroke position; and concluding movement of the shaft in response to the controller determining that the total volume of pumped fluid has reached the target volume.

* * * * *